US006873102B2

(12) United States Patent
Martelli et al.

(10) Patent No.: US 6,873,102 B2
(45) Date of Patent: Mar. 29, 2005

(54) EVAPORABLE GETTER DEVICE WITH METALLIC NETS

(75) Inventors: Daniele Martelli, Milan (IT); Marialuisa Mantovani, Lainate (IT); Giuseppe Urso, Seregno (IT)

(73) Assignee: Saes Getters S.p.A., Lainate (IT)

( * ) Notice: Subject to any disclaimer, the term of this patent is extended or adjusted under 35 U.S.C. 154(b) by 0 days.

(21) Appl. No.: 10/721,199

(22) Filed: Nov. 25, 2003

(65) Prior Publication Data

US 2004/0104675 A1 Jun. 3, 2004

Related U.S. Application Data

(63) Continuation of application No. PCT/IT02/00405, filed on Jun. 20, 2002.

(30) Foreign Application Priority Data

Jun. 26, 2001 (IT) ..... MI2001A1341

(51) Int. Cl.[7] ..... H01J 61/26
(52) U.S. Cl. ..... 313/553; 417/48; 417/51
(58) Field of Search ..... 313/553–562; 417/48–51

(56) References Cited

U.S. PATENT DOCUMENTS

| | | | | |
|---|---|---|---|---|
| 3,560,788 A | | 2/1971 | Reash et al. | |
| 4,128,782 A | | 12/1978 | Fransen et al. | |
| 4,961,040 A | | 10/1990 | della Porta et al. | |
| 5,191,980 A | * | 3/1993 | Boffito et al. | 206/524.4 |
| 5,443,410 A | | 8/1995 | Ko | |
| 5,508,586 A | | 4/1996 | Martelli et al. | |
| 5,544,490 A | * | 8/1996 | Manini et al. | 62/46.1 |
| 6,071,080 A | | 6/2000 | Van Der Wilk et al. | |

FOREIGN PATENT DOCUMENTS

| | | |
|---|---|---|
| EP | 0 146 685 A2 | 7/1985 |
| EP | 0 853 328 A1 | 7/1998 |
| IT | 1295896 | 5/1999 |
| WO | WO 00/07209 A1 | 2/2000 |
| WO | WO 00/28568 A1 | 5/2000 |

* cited by examiner

*Primary Examiner*—Joseph Williams
(74) *Attorney, Agent, or Firm*—Akin Gump Strauss Hauer & Feld, LLP

(57) ABSTRACT

An evaporable getter device is provided for cathode-ray tubes (CRTs). The getter device is formed by a metallic container (101; 201) containing a mixture of powders (104; 205) of the compound $BaAl_4$ and nickel (Ni), and by two different metallic nets (106, 107; 207, 208), superimposed and positioned in the container over the powders. The device allows one to obtain a barium distribution in the CRT that is more uniform and wider than that obtainable with a conventional getter device.

9 Claims, 4 Drawing Sheets

EVAPORABLE GETTER DEVICE WITH METALLIC NETS

CROSS-REFERENCE TO RELATED APPLICATIONS

This application is a continuation of International Application No. PCT/IT02/00405, filed Jun. 20, 2002, which was published in the English language on Feb. 6, 2003, under International Publication No. WO 03/010790 A1 and the disclosure of which is incorporated herein by reference.

BACKGROUND OF THE INVENTION

The present invention relates to an evaporable getter device for cathode-ray tubes (CRTs), used in television sets and monitors.

As known in the art, getter materials are used in any applications wherein the maintenance of vacuum is required for a long time. In particular, CRTs contain evaporable getter materials capable of fixing traces of harmful gases that would compromise proper operation of the CRT.

Trace gases may be left in CRTs during the production stage, even though an evacuation step is performed before final sealing of the tube, or trace gases may come from degassing of the materials forming the tubes.

To remove these trace gases, barium metal is used, which is deposited in the form of a thin film on the internal walls of the CRT. This deposition is accomplished by a so-called evaporable getter device, formed by an open metallic container filled with a mixture of powders of a barium compound, usually $BaAl_4$, and nickel, Ni, capable of releasing barium by evaporation after sealing of the CRT. This mixture is referred to in the following as $BaAl_4$/Ni.

In order to evaporate barium, the container is heated preferably by induction, through a coil placed outside the tube, thus causing an increase in temperature of the powders to about 800° C. At these temperatures a strongly exothermic reaction takes place between $BaAl_4$ and Ni, that causes a further rise of temperature to about 1200° C., at which temperature barium evaporates. The metal then condenses in the form of a film on the conical wall and the mask of the CRT. This barium film is the active element in the gettering of gases.

For optimal working of the CRT it is required that the barium film have a thickness as uniform as possible. A deposit of uneven thickness may have small projections from which, through gas absorption, barium particles may be lost which have a high probability to end up on the electron gun and/or on the mask. In the first case, these particles may cause electric arcs and short circuits, while in the second case, they obstruct the passage of electrons and hence the formation of the image, thus causing the onset of dark spots on the screen. Moreover, a barium film with zones of high thickness has worsened characteristics of saturation by gases, consequently causing a reduction in the absorbing capacity of the getter.

In order to cope with these problems, Italian Patent IT 1,295,896 in the name of SAES Getters S.p.A. describes a baffle that allows diffusion of the barium vapors along the walls of the tube to produce even deposits. Through the use of such a baffle the distribution of barium is improved, that becomes wider, more reproducible and deposited on the walls of the CRT tube without involving the mask and the phosphors-bearing surface. In this case too, however, the barium layer shows a rather uneven thickness, thus not solving some of the above-mentioned drawbacks in a fully satisfactory way.

U.S. Pat. No. 4,128,782 describes a U-shaped device containing a mixture of $BaAl_4$/Ni with which titanium hydride ($TiH_2$) is mixed. When the barium evaporation temperature is reached, $TiH_2$ decomposes and the hydrogen thus formed acts as a diffusing means for the barium atoms that, by repeatedly hitting hydrogen molecules, travel non-linear paths and spread over a wide surface, thus forming deposits with a more regular thickness compared to the devices not containing the hydride. In this case, however, the extra-component, $TiH_2$, subtracts part of the volume available for the $BaAl_4$/Ni mixture. Therefore, with the same dispenser size, there is released inside the CRT a lower barium amount than what would be released without the third component. In addition, titanium hydride is a rather expensive and troublesome material to handle, as it is readily flammable and reacts violently with water. A production process involving such a compound would thus entail problems related to safety and difficult to manageability.

BRIEF SUMMARY OF THE INVENTION

The object of the present invention is to provide a device that overcomes the above mentioned drawbacks.

The object is achieved by an evaporable getter device comprising a metallic container containing a mixture of powders of the $BaAl_4$ compound and nickel, as well as two metallic nets having different wire diameters and apertures, that are superimposed and inserted in the container over the powders.

The net facing the powders of the mixture may be in direct contact with the powders or not (the following description, with reference to the attached drawings, exemplifies devices where the nets are not in contact with the powders). Either the finer net or the one with larger wire diameter and apertures can be placed in the container facing the mixture $BaAl_4$/Ni, but the arrangement where the net with wires of larger diameter faces the mixture is preferred, because this avoids the risk that the wires of lower diameter will melt during barium evaporation. This arrangement will be referred to for convenience in the remainder of the description.

The fundamental advantage of the getter device according to the invention is to obtain during evaporation an even barium distribution, leading to a metal film of almost constant thickness in the conical part and on the mask of the CRT.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
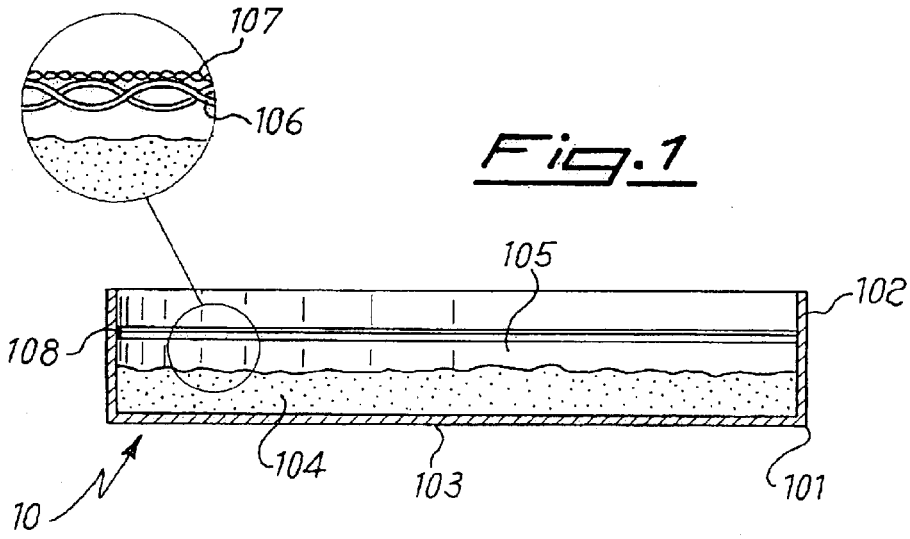
FIG. 1 is a side sectional view with enlarged detail of a getter device according to a first embodiment of the invention.

In the view of FIG. 1 there is illustrated the section of a device 10 according to a first embodiment of the invention. Container 101 has a cylindrical shape and is made from a circular metal sheet, drop-forged so as to obtain an outer wall 102 and a bottom wall 103, defining a space 105 where powders 104 of the mixture $BaAl_4$/Ni are placed. Over the powders there is placed a first metal wire net 106, and over it a second metal wire net 107 (as shown in the enlarged detail). In this first embodiment the nets are secured to the outer wall 102 of container 101 by welding, for instance spot welding, as indicated in the drawing as element 108.

Figure 2:
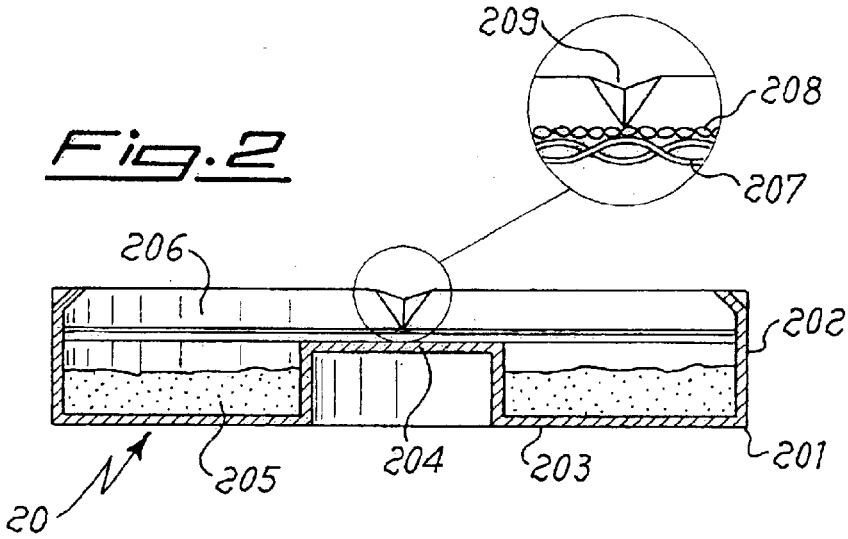
FIG. 2 is a side sectional view with enlarged detail of a getter device according to a second embodiment of the invention.

In FIG. 2 there is illustrated a device 20 according to a second embodiment of the invention. In this case container 201 has an annular form and is made of a circular metal sheet, drop-forged so as to obtain an outer wall 202, a bottom wall 203 and a central coaxial rise 204. Walls 202 and 203 and rise 204 define an annular space 206 in which the powders 205 of the mixture $BaAl_4$/Ni are placed. Over the powders of mixture $BaAl_4$/Ni and in contact with central rise 204, there is arranged a first metal wire net 207 and thereon a second metal wire net 208 (as shown in the enlarged detail). In this embodiment, the nets are held in position by mechanical deformations 209 that are produced on outer wall 202 by means of a punch. Such deformations appear as pointed recesses with an almost triangular section, which from the outer perimeter of wall 202 extend inwardly in the container 201, thus holding the nets in a steady position. Obviously nets 207 and 208 can also be secured to container 201 by welding. Similarly, in the case of container 101, the nets 106 and 107 can be held in position by mechanical deformations of outer wall 102.

The container (101, 201) and the nets (106, 107, 207, 208) are preferably made of steel. Preferred are the steels classified by the American Iron and Steel Institute (AISI) in the series AISI 300 and AISI 400, and particularly steel AISI 304.

The larger net is selected so as to have a wire diameter between 0.3 and 1.5 mm and apertures between 1.4 and 2.4 mm. The finer net 107 is selected with a wire diameter between 0.025 and 0.050 mm and apertures between 0.025 and 0.075 mm.

The advantages of the present invention will be evident from the following example.

EXAMPLE

A device according to the invention is placed inside a 20 inch CRT in an "antenna" arrangement, that is, mounted on a thin rod connected to the tube wall.

Figure 3:
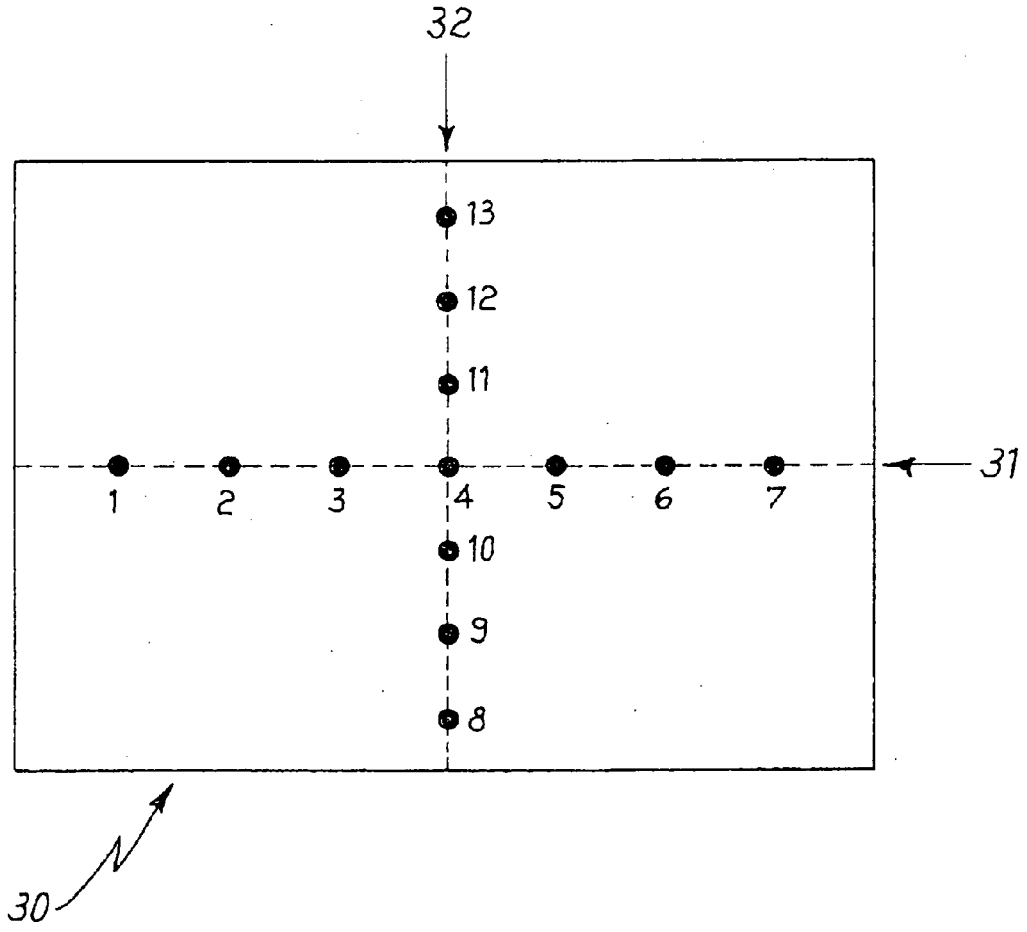
FIG. 3 is a schematic diagram of a mask of a CRT used in the experimental control of the invention.

FIG. 3 schematically represents the mask 30 of the CRT, on which are positioned two sets of nickel disks having a diameter of 1 cm: a first set is disposed along main axis 31 and the second set along minor axis 32, so that the disk positioned in the center of the mask is the fourth of both sets. The disks are placed at a distance of 5.1 cm from each other along main axis 31 and at a distance of 3.8 cm along minor axis 32.

The CRT is then evacuated and sealed, and the getter device is inductively heated through a coil placed outside the tube at a position corresponding to the point where the device is arranged. After barium evaporation, the nickel disks are drawn, recording the original position in the CRT of each of these. Each disk is then placed in a beaker containing 100 cc of a 0.1 N aqueous solution of hydrochloric acid (HCl), thus dissolving the barium deposited on it. The barium concentration of the thus obtained solutions is quantitatively measured by atomic absorption spectroscopy, and it is then possible from the measured concentration to obtain the amount of barium originally present on each disk.

The same procedure is then repeated by replacing the inventive device with a prior art device.

Figure 4:
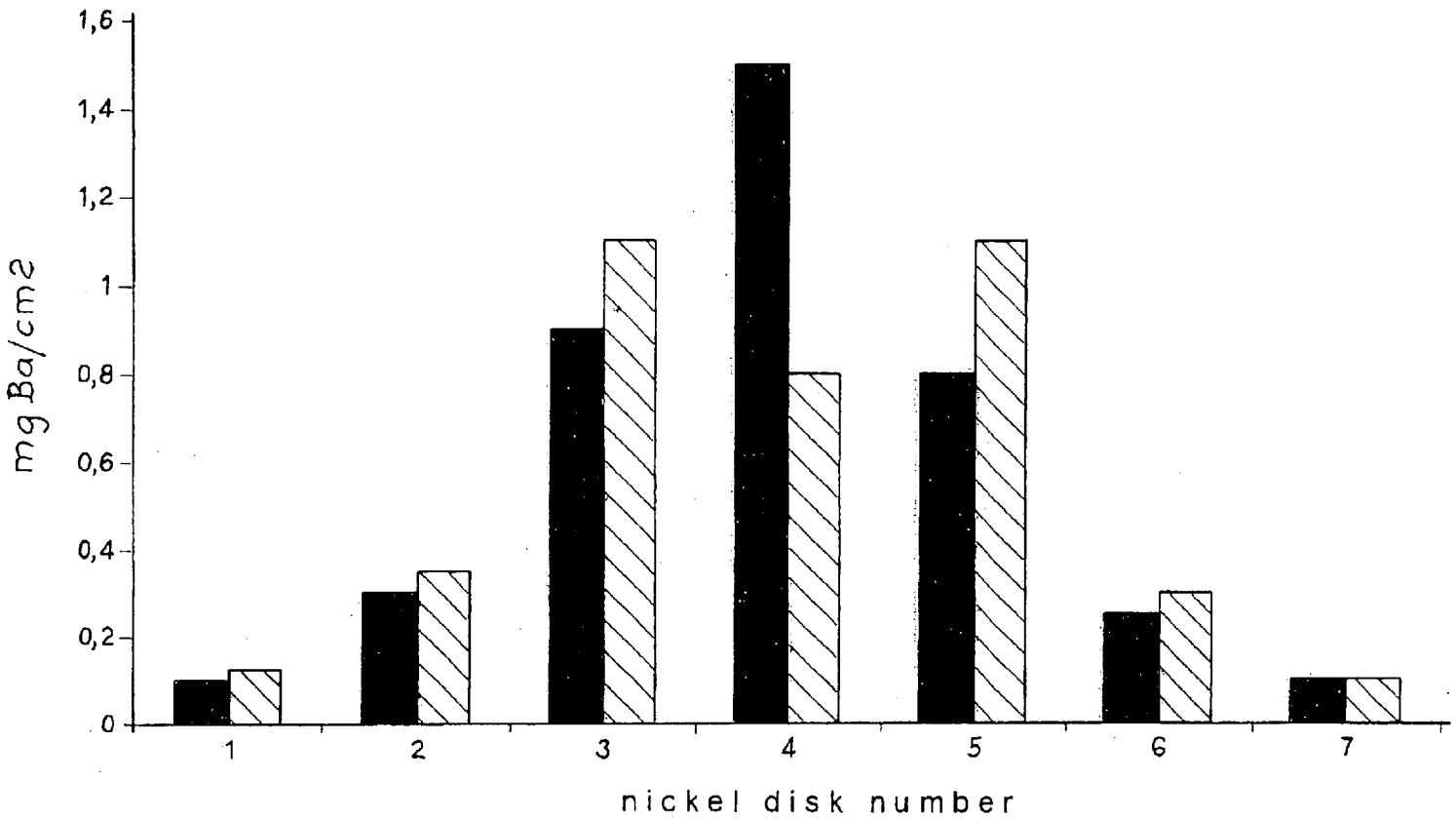
FIGS. 4 and 5 are bar graphs of the barium distribution results of evaporation tests carried out with inventive getter devices and prior art getter devices.
Figure 5:
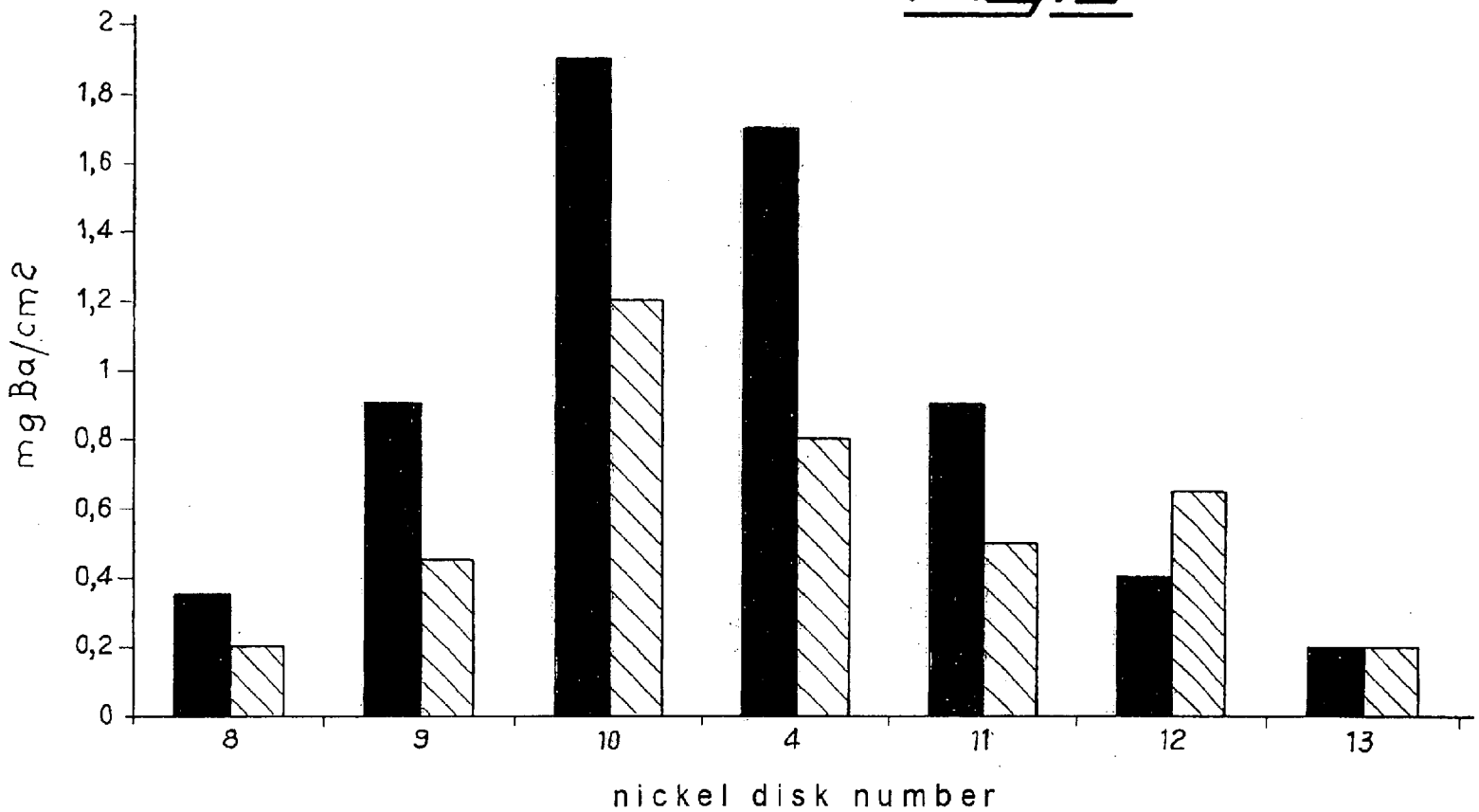

In FIGS. 4 and 5 there are shown the bar graphs reporting the amount of barium on each nickel disk in milligrams per square centimeter (mg Ba/cm$^2$), as a function of the disk position on the mask of the CRT (the numbers on the abscissa correspond to the numbering of disks in FIG. 3). In particular, FIG. 4 shows the barium distribution on the disks arranged along main axis 31, and FIG. 5 shows the barium distribution on the disks arranged along minor axis 32 of the mask. The amounts of barium are given in histograms, by hatched bars in the case of the devices of the invention and by full bars in the case of the prior art devices.

As is clearly visible from the graphs, with the inventive devices a more even distribution of barium metal is obtained in comparison with the distribution that can be obtained with the conventional devices.

Thanks to the presence and coupling of the two metal nets, another advantageous effect is obtained, that is, a remarkable abatement of particle loss from the $BaAl_4$/Ni mixture, both during the production stage and operation of the CRTs. This allows avoidance of the above-mentioned drawbacks due to the presence of free particles.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An evaporable getter device (10, 20) comprising a metallic container (101, 201) containing a mixture (104, 205) of $BaAl_4$ powder and Ni powder, and two metallic nets (106, 107, 207, 208) having different wire diameter and apertures, the nets being superimposed and inserted in the container over the powders.

2. The device according to claim 1, wherein the first net (106, 207) has a wire diameter between 0.3 and 1.5 mm and apertures between 1.4 and 2.4 mm, and the second net (107, 208) has a wire diameter between 0.025 and 0.050 mm and apertures between 0.025 and 0.075 mm.

3. The device according to claim 2, wherein the first net faces the mixture of powders.

4. The device (10) according to claim 1, wherein the container (101) for the powders has a cylindrical shape, the container having an outer wall (102) and a bottom wall (103) defining a space (105) containing the powders (104).

5. The device (20) according to claim 1, wherein the container (201) for the powders has an annular shape, the container having an outer wall (202), a bottom wall (203), and a central rise (204) defining an annular space (206) containing the powders (205).

6. The device according to claim 1, wherein the metallic nets (106, 107, 207, 208) are secured to an outer wall (102, 202) of the container by welding.

7. The device according to claim 1, wherein the metallic nets (106, 107, 207, 208) are held in position inside the container by recesses of an outer wall (102, 202) obtained by mechanical deformation of the outer wall.

8. The device according to claim 1, wherein the container (101, 201) and the metallic nets (106, 107, 207, 208) are formed of a steel selected from the group of steels consisting of those in AISI 300 and AISI 400 series.

9. The device according to claim 8, wherein the steel comprises AISI 304 steel.

* * * * *